US008747108B2

(12) United States Patent
Lona Santoyo et al.

(10) Patent No.: US 8,747,108 B2
(45) Date of Patent: Jun. 10, 2014

(54) TRIPLE FLAME SECTION BURNER

(75) Inventors: Jose Arturo Lona Santoyo, Santiago de Queretaro (MX); Ernesto Arias Del Campo, Santiago de Queretaro (MX); Roberto Cabrera Botello, Santiago de Queretaro (MX)

(73) Assignee: Mabe, S.A. de C.V., Queretaro (MX)

( * ) Notice: Subject to any disclaimer, the term of this patent is extended or adjusted under 35 U.S.C. 154(b) by 749 days.

(21) Appl. No.: 12/970,311

(22) Filed: Dec. 16, 2010

(65) Prior Publication Data

US 2011/0151385 A1 Jun. 23, 2011

(30) Foreign Application Priority Data

Dec. 18, 2009 (MX) ..... MX/a/2009/014047

(51) Int. Cl.
*F23Q 9/00* (2006.01)

(52) U.S. Cl.
USPC ..... 431/284; 431/2; 431/285; 431/354; 126/39 B; 126/39 E; 126/39 R

(58) Field of Classification Search
CPC ..... F23D 14/06
USPC ..... 431/2, 284, 285, 354; 126/39 E, 39 B, 126/39 K, 39 H
See application file for complete search history.

(56) References Cited

U.S. PATENT DOCUMENTS 1,598,996 A 9/1926 Wheelock
5,649,822 A * 7/1997 Gertler et al. ..... 431/354
5,690,483 A * 11/1997 Oda et al. ..... 431/266
5,800,159 A * 9/1998 Maughan et al. ..... 431/349
6,035,846 A * 3/2000 Saleri ..... 126/39 H
6,092,518 A * 7/2000 Dane ..... 126/214 D
6,132,205 A * 10/2000 Harneit ..... 431/354

(Continued)

FOREIGN PATENT DOCUMENTS

CN 2619154 6/2004
CN 2906347 5/2005

(Continued)

*Primary Examiner* — Avinash Savani
*Assistant Examiner* — John C Hailey, III
(74) *Attorney, Agent, or Firm* — Enrique J. Mora; Beusse Wolter Sanks Mora & Maire, P.A.

(57) ABSTRACT

The present invention relates to the field of burners, particularly in burners intended for household use, such as stoves. A three ring burner is described, which produces longer and more inclined flames through which a more efficient heating is accomplished; combustion ports in the rings with straight or helicoid arrangements; where the inner ring can function in conjunction with or independently from the other two flame rings, thus controlling the heating intensity and the flame by means of controlling the velocity of the gas-air current; as main parts comprising; a burner head, which contains three concentric flame rings, one inner ring, one intermediate ring and one outer ring, each flame ring containing combustion ports, the collection of combustion ports are helicoid both in their inner ring as well as the outer ring, two lids on the burner head, one inner and the other outer; one cover for the burners which forms the surface of the heating apparatus; Venturi ducts on the lower part of the burner head; a support firmly joined to the surface of the heating apparatus, in this support are lodged Venturi ducts from the burner head; a gas distributor lodged in the lower part of the support, where the gas distributor has three gas exits, two laterals and one central.

20 Claims, 11 Drawing Sheets

(56) References Cited

U.S. PATENT DOCUMENTS

| | | | | |
|---|---|---|---|---|
| 6,325,619 | B2 * | 12/2001 | Dane | 431/284 |
| 6,332,460 | B1 * | 12/2001 | Paesani | 126/39 R |
| 7,017,572 | B2 * | 3/2006 | Cadima | 126/39 E |
| 7,291,009 | B2 * | 11/2007 | Kamal et al. | 431/284 |
| 7,594,812 | B2 * | 9/2009 | Armanni | 431/283 |
| 7,661,954 | B2 * | 2/2010 | Harneit | 431/278 |
| 7,841,332 | B2 * | 11/2010 | Pottenger et al. | 126/39 E |
| 7,901,205 | B2 * | 3/2011 | Trochou | 431/284 |
| 8,206,148 | B2 * | 6/2012 | Paesani | 431/284 |
| 8,221,116 | B2 * | 7/2012 | Biagioli et al. | 431/284 |
| 8,302,593 | B2 * | 11/2012 | Cadima | 126/39 R |
| 2004/0234915 | A1 * | 11/2004 | Koch et al. | 431/278 |
| 2007/0218414 | A1 * | 9/2007 | Harneit | 431/354 |
| 2010/0206293 | A1 * | 8/2010 | Padgett et al. | 126/39 E |
| 2010/0263658 | A1 * | 10/2010 | Ryu et al. | 126/39 E |
| 2010/0319677 | A1 * | 12/2010 | Lacche | 126/39 E |
| 2011/0011389 | A1 * | 1/2011 | Ryu et al. | 126/39 E |
| 2011/0048400 | A1 * | 3/2011 | Biagioli et al. | 126/39 E |
| 2011/0120445 | A1 * | 5/2011 | Armanni | 126/39 E |
| 2011/0290231 | A1 * | 12/2011 | Padgett | 126/215 |
| 2013/0306055 | A1 * | 11/2013 | Cadima | 126/39 E |

FOREIGN PATENT DOCUMENTS

| | | |
|---|---|---|
| CN | 2714995 | 8/2005 |
| CN | 1687643 | 10/2005 |
| CN | 2896036 | 5/2007 |
| CN | 201037645 | 3/2008 |
| CN | 201251184 | 6/2009 |
| EP | 0554511 | 10/1993 |
| JP | 2005061688 | 3/2005 |
| JP | 2006138591 | 6/2006 |
| KR | 20040105911 | 12/2004 |
| WO | WO 2006005428 A1 * | 1/2006 |

* cited by examiner

TRIPLE FLAME SECTION BURNER

RELATED APPLICATIONS

This application claims priority from Mexican application Serial No. MX/a/2009/014047 filed Dec. 18, 2009, which is incorporated herein by reference in its entirety.

FIELD OF INVENTION

The present invention relates to the field of burners, particularly burners used in household appliances, such as stoves.

BACKGROUND

Currently in the market there are a considerable amount of burners for use in household appliances, initially the primary objective of these, was to provide of a flame which would have an impact on the utensils needing to be heated, without considering efficiency of use or ecological aspects of the combustibles used in heating; with time the design of burners has evolved towards the resolution of the aspects mentioned above, among others.

As background to the present invention, the applicant has had knowledge of the documents which are described below.

Published patent application EP 0554511, describes a gas burner with atmospheric gas with a pre-mixer for primary gas, with a one ring burner which has ducts for gas exit and a cover for the burner, designed if appropriate, as one sole piece with the ring, as a solution produced for atmospheric burners which in particular has a NO content in the burn gas produced, as well as CO content is considerably reduced, and in particular in a very wide range of adjustment between the open and closed positions. The above is achieved due to the central axis of the exit ducts having a deviation angle of 0° regarding an assigned radius to the respective aperture of the exit.

The invention in the present application differs considerably from that contained in the publication EP0554511, where among other aspects which differentiate it, the burner in the present invention is made up of a burner with three rings, with a combustion ports design which are not described in the aforementioned document.

U.S. Pat. No. 1,598,996 describes gas burners for general use where the inner parts are freely accessible which allow the burner to be cleaned quickly and conveniently to eliminate carbon, grease and other deposits. At the same time, this burner has an upper lid which can be removed from the burner for the aforementioned purposes, and which at the same time has a firm connection which seals the burner's body against any possibility of combustible leakage between the lid's contact surface and the burner's body. Additionally, the burner has two parts where the body of the burner is coupled to a mixture tube which is adapted to be removed by a sliding movement. The burner has means to ensure a mix of air and combustibles previous to ignition and the burning of the combustible, to reduce carbon deposits to a minimum and produce the flame with the greatest possible intensity.

Chinese Utility Model application with a publication number CN 201251184, describes a stove burner which contains: a primary induction channel, a secondary induction channel and a third induction channel which are in an injector, and are respectively connected in a fixed manner and communicate via a first gas channel, a second gas channel and a third gas channel. The gas for the dented inner ring's cover enters the second gas channel from the second induction channel; the gas for the cover of the dented outer ring enters into the first gas channel and the third gas channel from the first induction channel and the third induction channel. As a result, the gas can be completely mixed with air when it enters the injector. Three fire holes are arranged on the cover of the dented outer ring. The first fire hole is arranged on the inner elevation of the cover of the dented outer ring. The third fire hole is arranged on the extreme upper face of the cover of the dented outer ring. The second fire hole is arranged on the extreme upper face of the cover of the dented outer ring between the first fire hole and the third fire hole. The second fire hole and the third fire hole are inclined towards the center of the cover of the dented outer ring, and the elevation angle of the second fire hole is greater than the same of the third fire hole. As a result, the heat of the flame in the fire hole is more highly concentrated in the burner's interior and the formation of carbon monoxide and nitrogen and oxygen compounds are reduced. A block of fire rings is firmly placed on the outer surface of the cover of the dented outer ring to reduce heat loss.

In regards to the inventions detailed in the aforementioned documents, not one of them has the structural and operational characteristics of the burner, object of the present invention, for example, none of the previous inventions possesses at least two concentric sections of flames, which are produced due to the combination of Venturi ducts which end in intermediate or central sections of the concentric sections of the flames. None of the aforementioned inventions possess concentric sections which have different types of combustion ports in order to generate inclined flames which produce more efficient heating. Due to the previous discussion, none of the documents antecede the present invention.

One of the objectives of the present invention is to provide a burner with at least two sections, each section with two segments which produce longer and more inclined flames through which more efficient heating can be attained.

Another of the objectives of the present invention is to provide a burner with at least two sections, which has combustion ports with straight or heliocoid arrangements which produce longer and more inclined flames.

Another of the objectives of the present invention is to provide a burner with three sections, in which the inner ring forms the first section, where this can function in conjunction with or independently from the other two flame sections, thus controlling heat intensity.

Yet another objective of the present invention provides a burner with at least two sections which consists of means to control the exit velocity of the air-gas mixture reducing it to the point where no detachment of flame occurs.

BRIEF DESCRIPTION OF THE DRAWINGS

The following description of the drawings is set forth which accompany the present description and which help serve illustrate it.

DETAILED DESCRIPTION OF THE INVENTION

Figure 1:
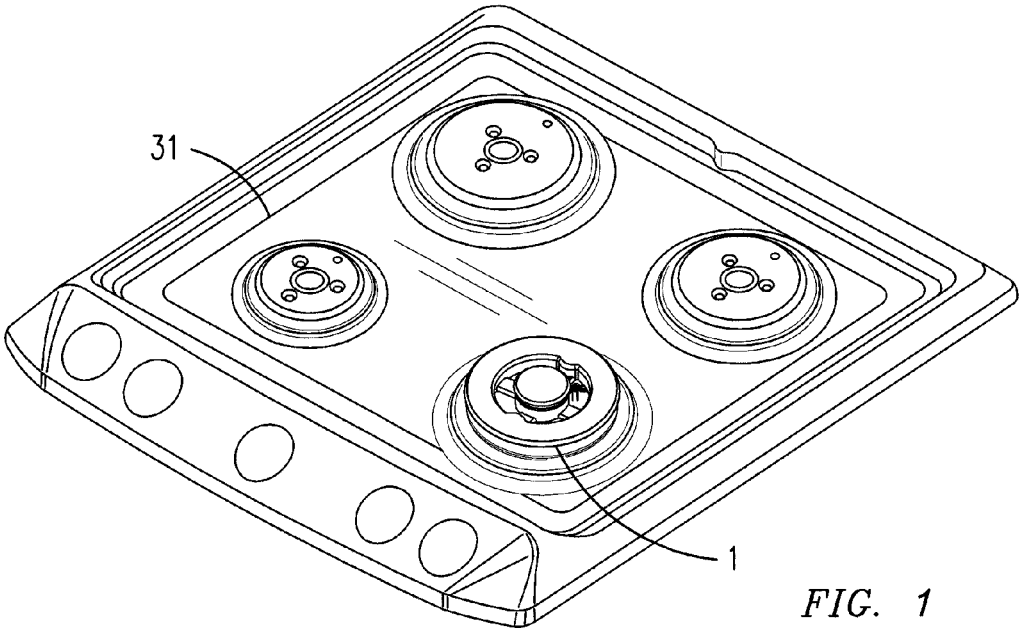
FIG. 1 shows an isometric view of the upper part of a stove with the burner of the present invention.
Figure 2:
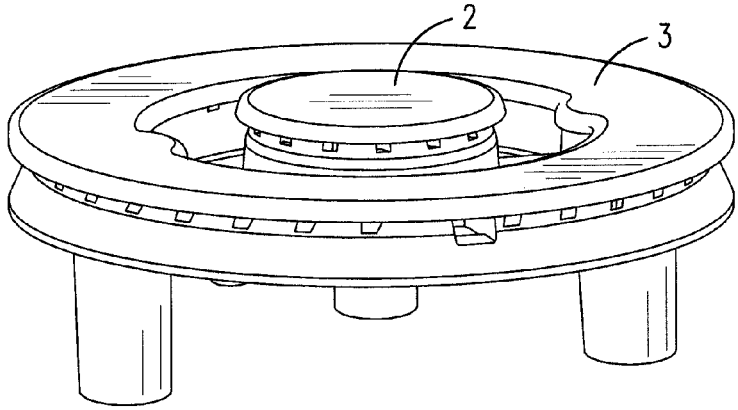
FIG. 2 shows a lateral view of the head of the three section burner with its outer and inner lids.
Figure 3:
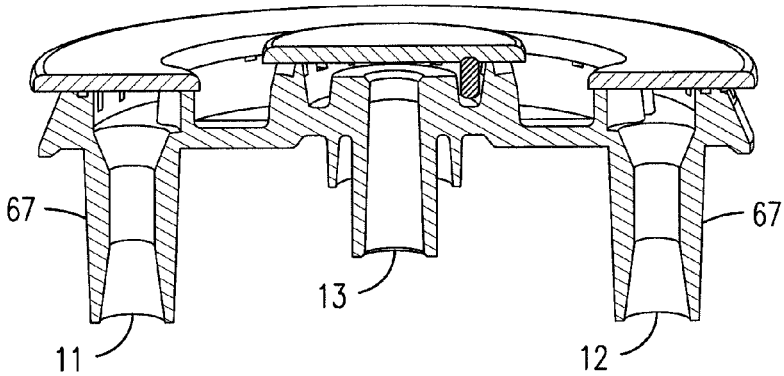
FIG. 3 refers to a cross section view of the head with three sections with its outer and inner lids.
Figure 4:
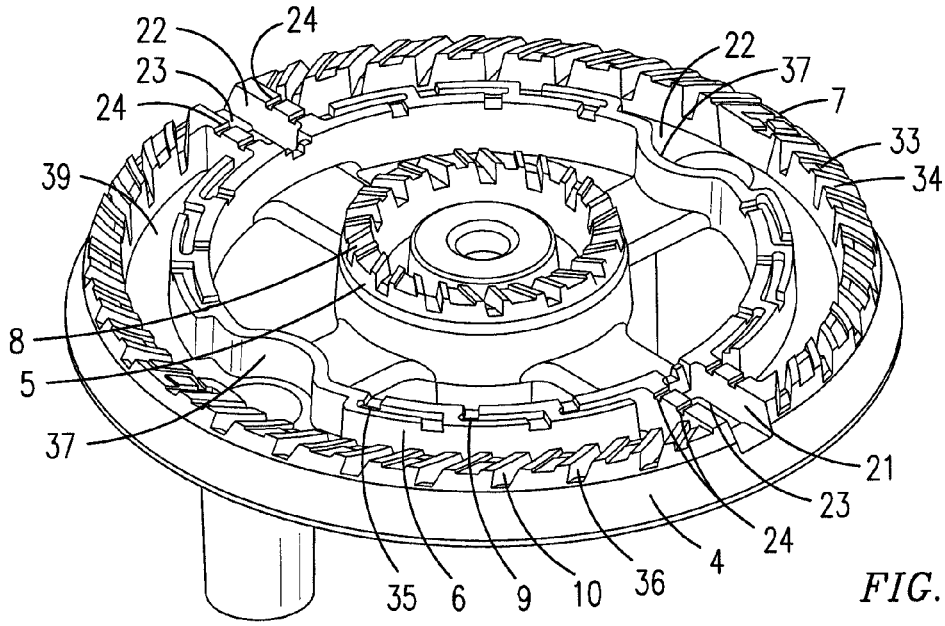
FIG. 4 is an isometric view of the upper part of the head of the three section burner.
Figure 5:
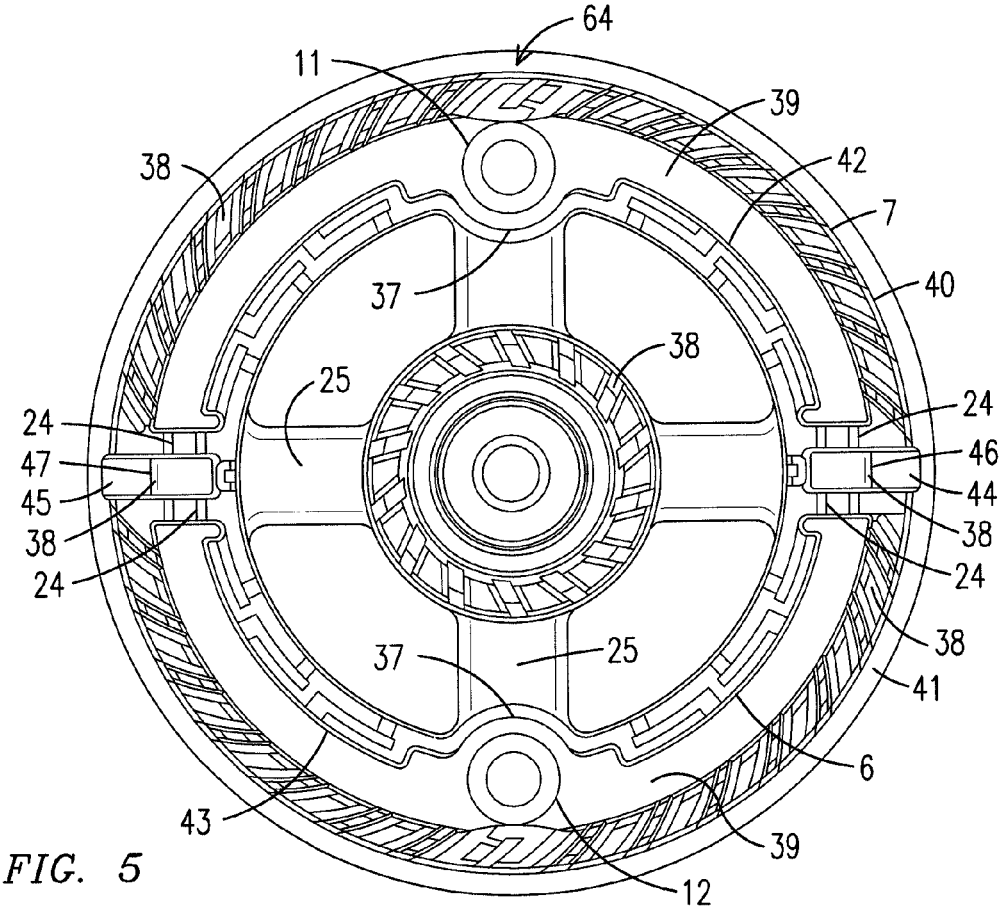
FIG. 5 shows an upper plant view of the head of the three section burner.
Figure 6:
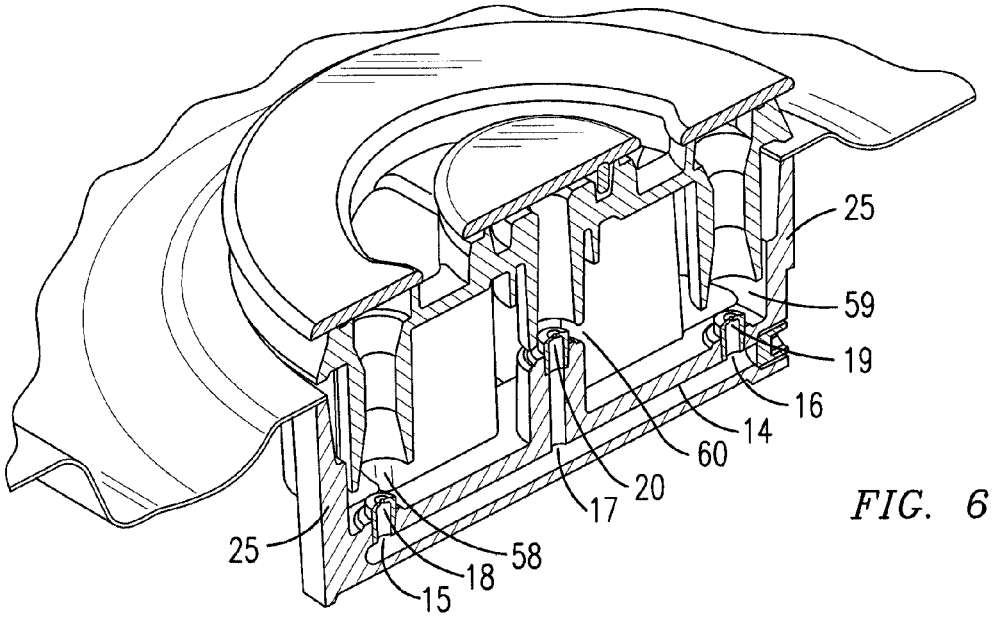
FIG. 6 shows a cross section of the three section burner.
Figure 7:
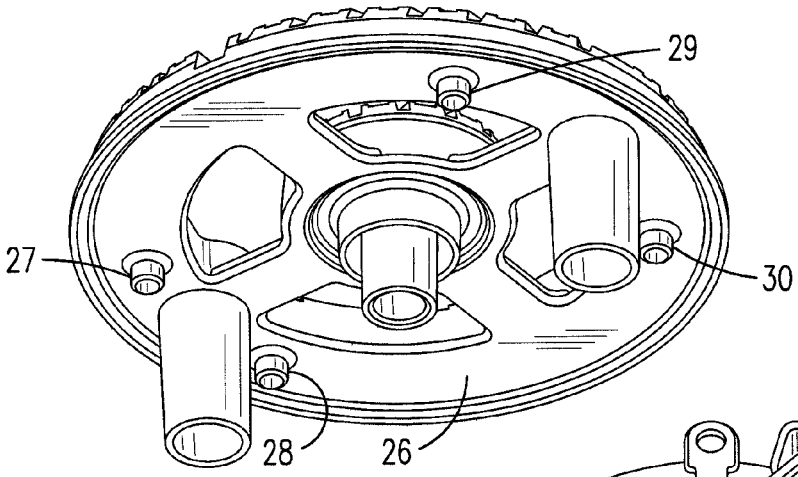
FIG. 7 refers to an isometric view of the lower part of the head of the three section burner.
Figure 15:
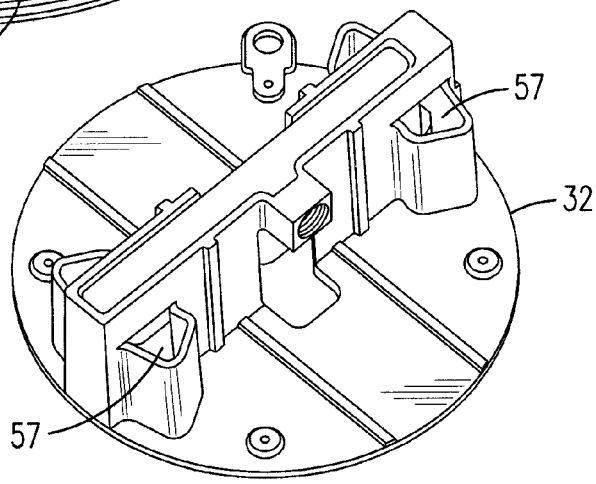
FIG. 15 is an isometric view through the lower part of the support base of the head of the three section burner.
Figure 8:
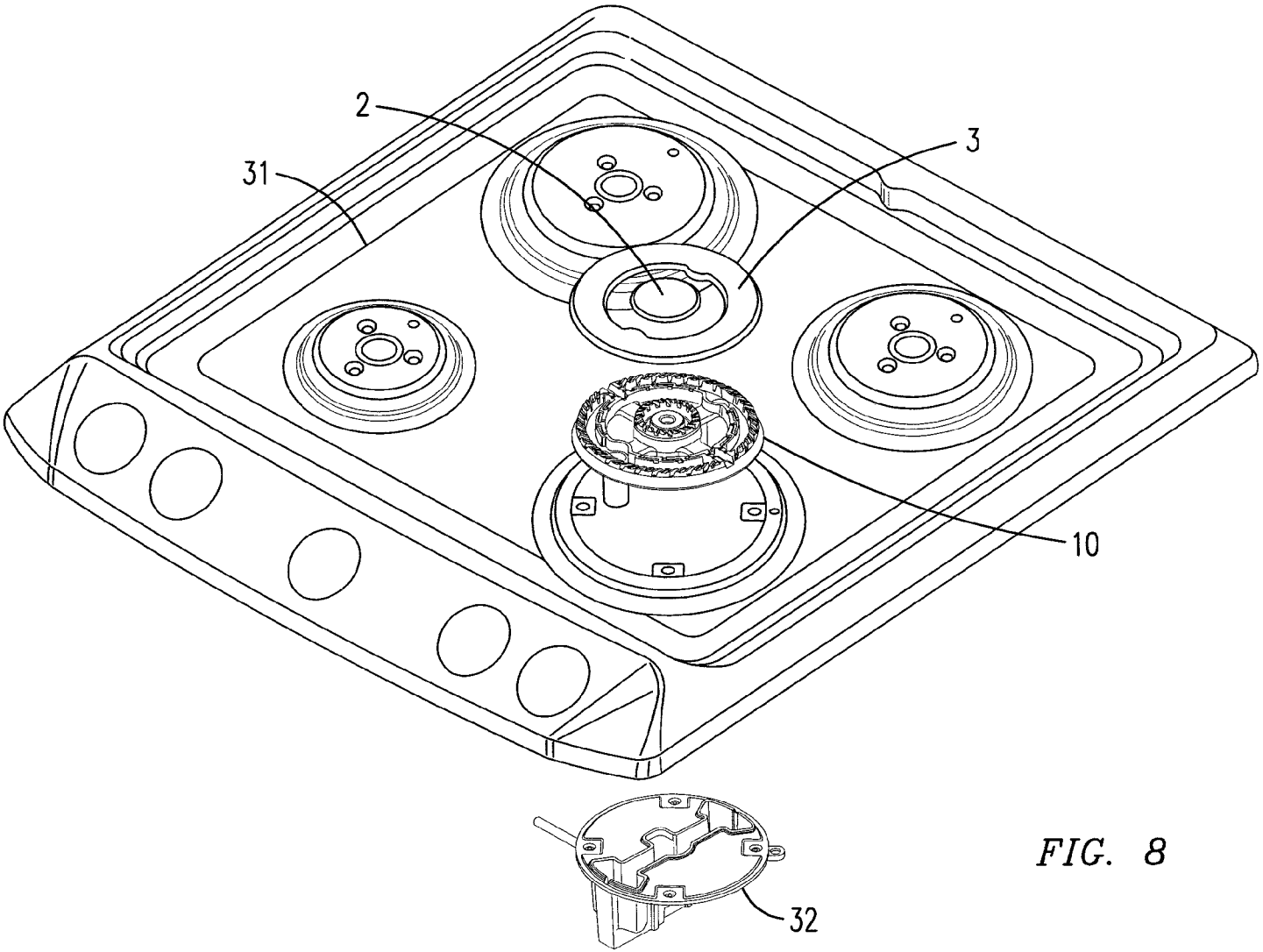
FIG. 8 is an isometric view of the stove's upper part as well as the burner head and its support.
Figure 9:
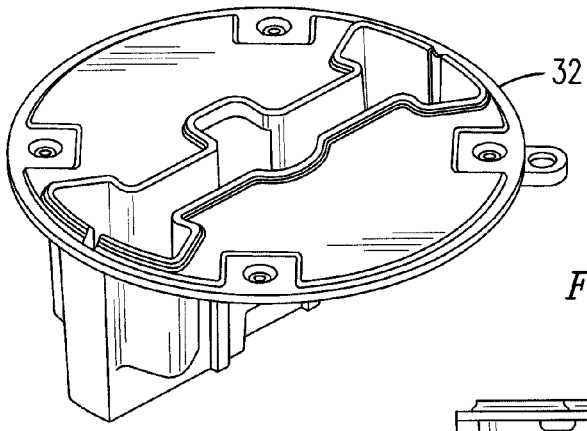
FIGS. 9 through 12 show various views of the supports of the head of the three section burner.
Figure 10:
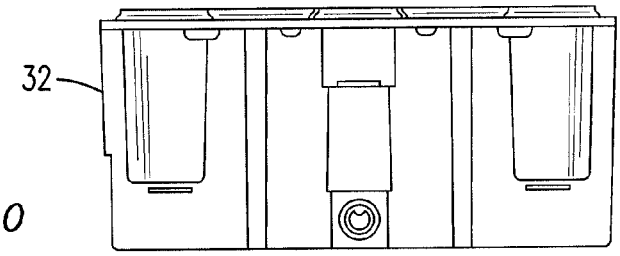
Figure 11:
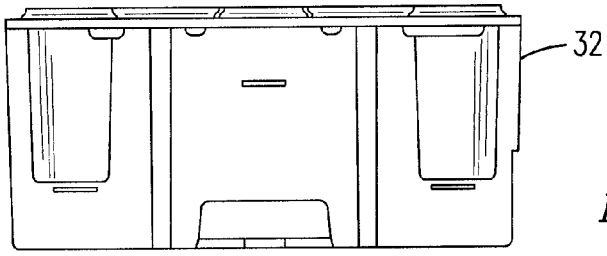
Figure 12:
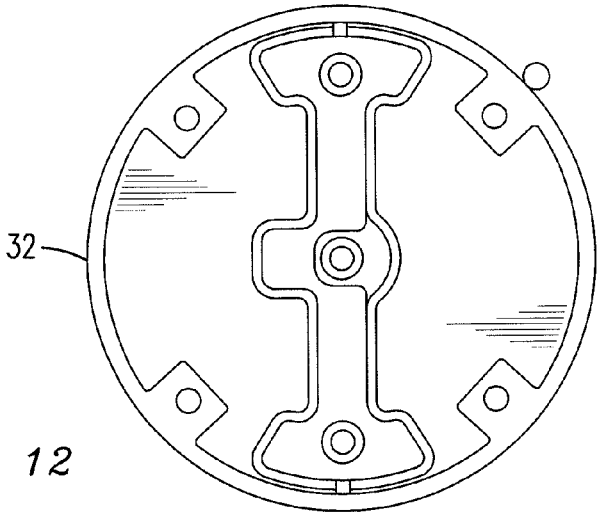
Figure 13:
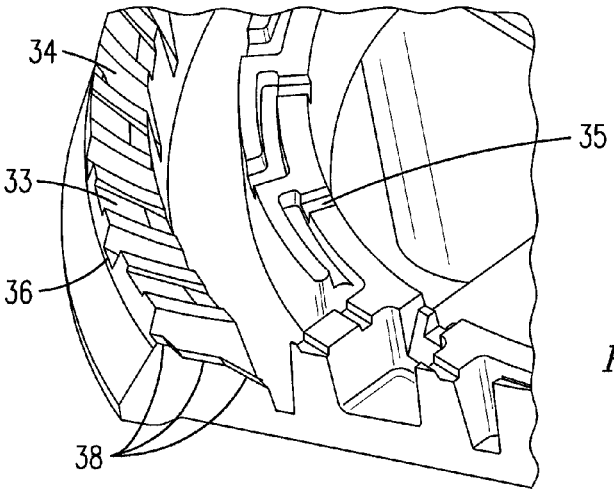
FIG. 13 shows a cross section of the head of the three section burner with its respective combustion ports.
Figure 14:
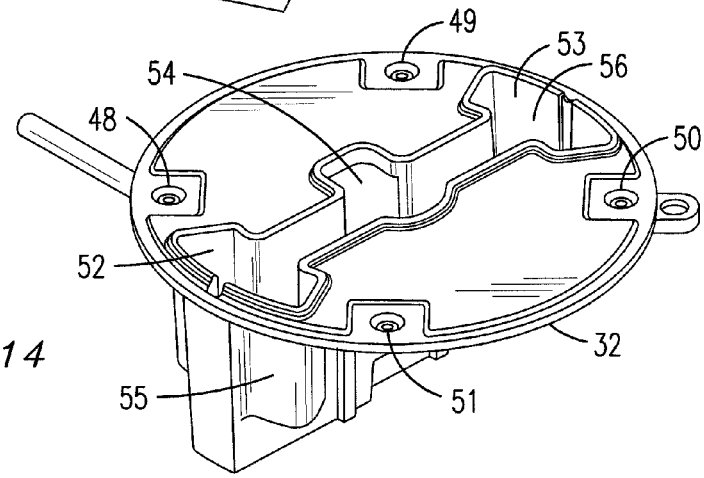
FIG. 14 refers to an isometric view of the support of the burner head with its lateral and central spaces.
Figure 16:
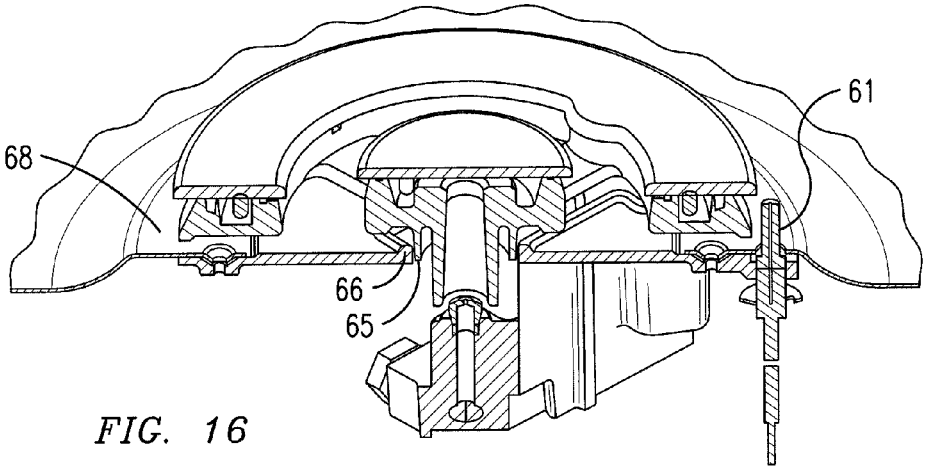
FIG. 16 shows a cross section of the three section burner in an embodiment which contains the closest spark plug to the outer ring.
Figure 17:
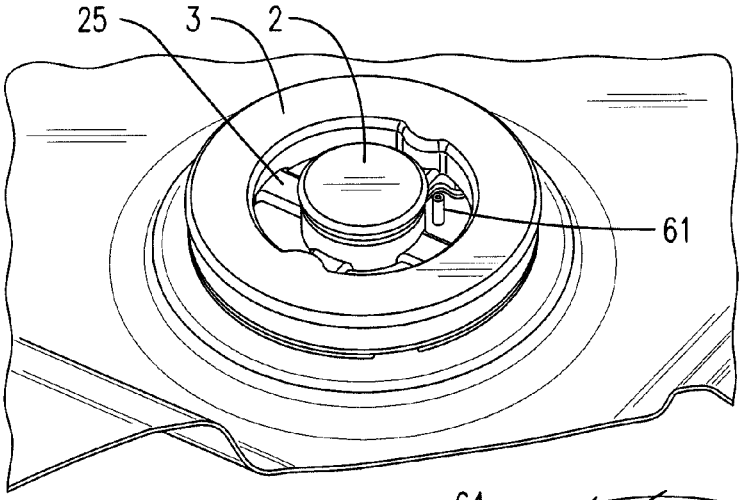
FIG. 17 shows a view with conventional perspective of the upper part of the three section burner in an embodiment which contains the lighting spark plug closest to the internal ring.
Figure 19:
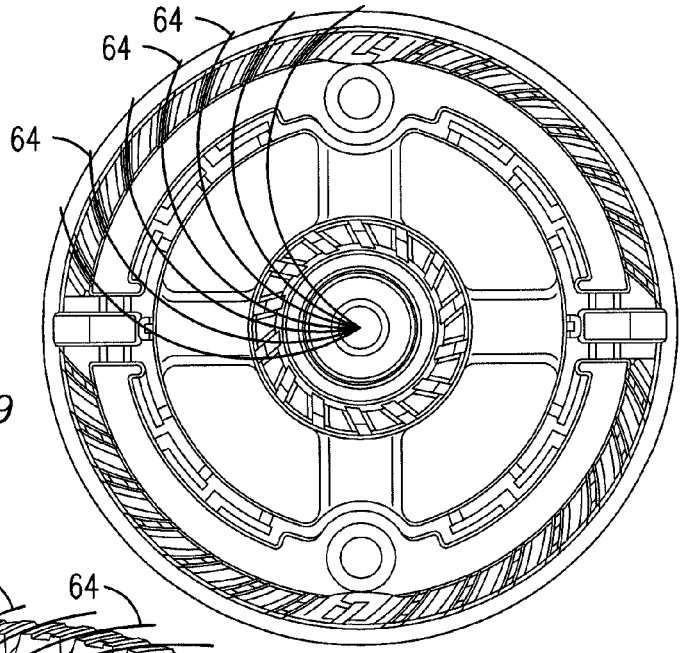
FIG. 19 shows a view in plant of the circumference arch of the burner's combustion ports.
Figure 20:
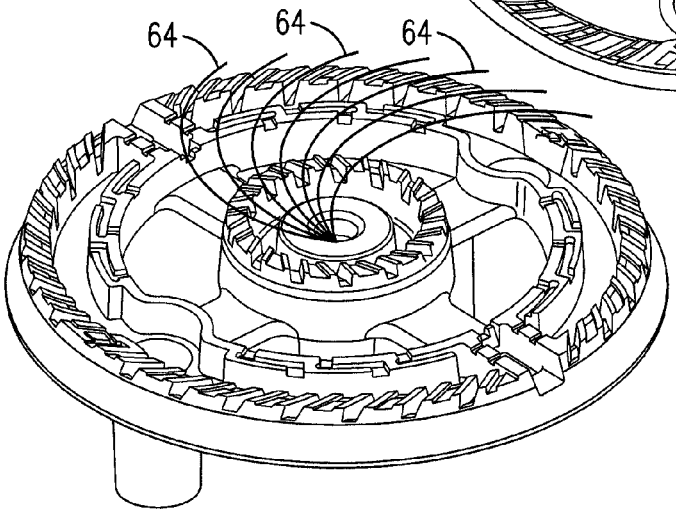
FIG. 20 is an isometric view of the circumference arch of the burner's combustion ports.
Figure 18:
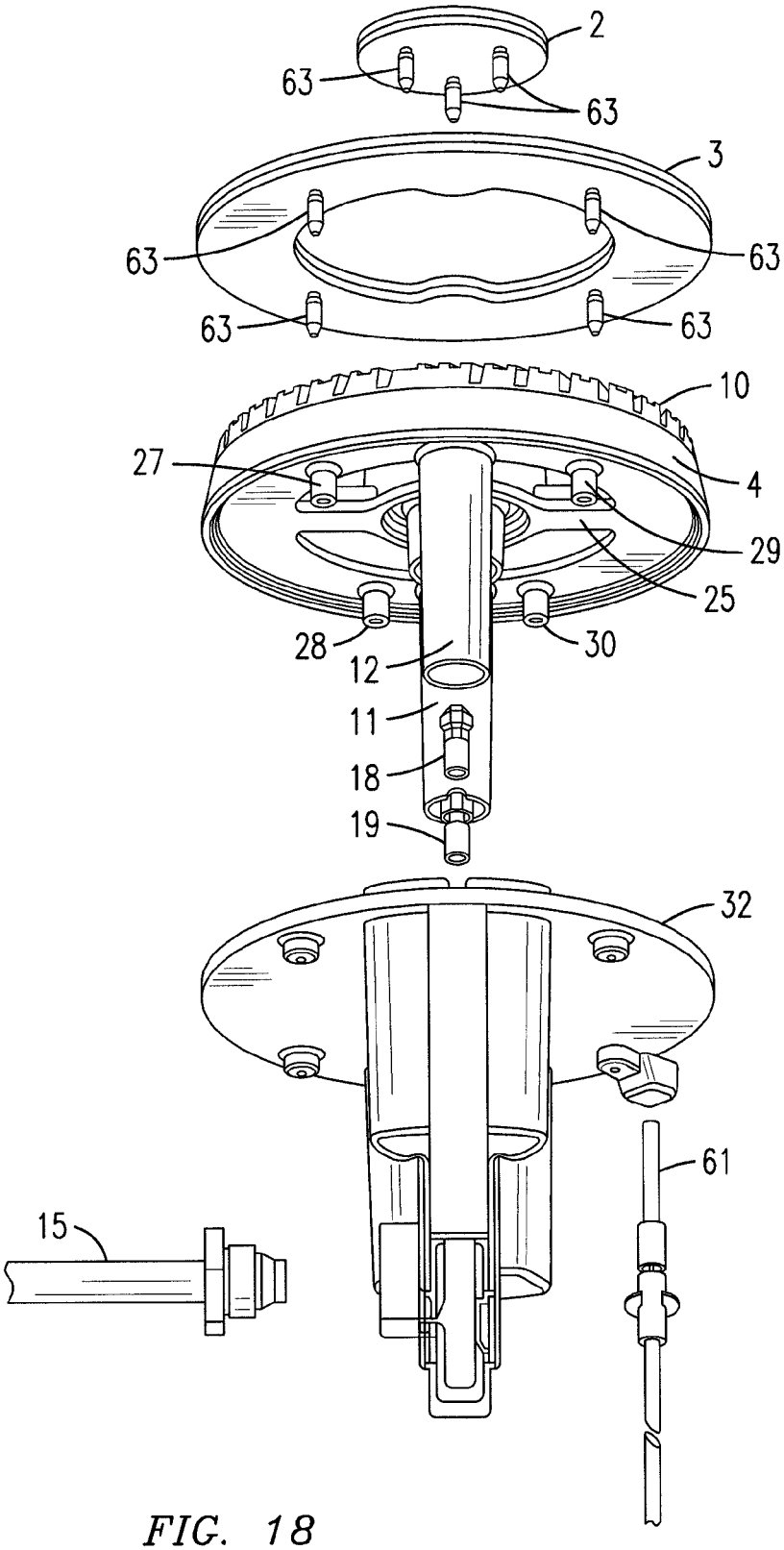
FIG. 18 refers to an enlarged view of the three section burner.
Figure 21:
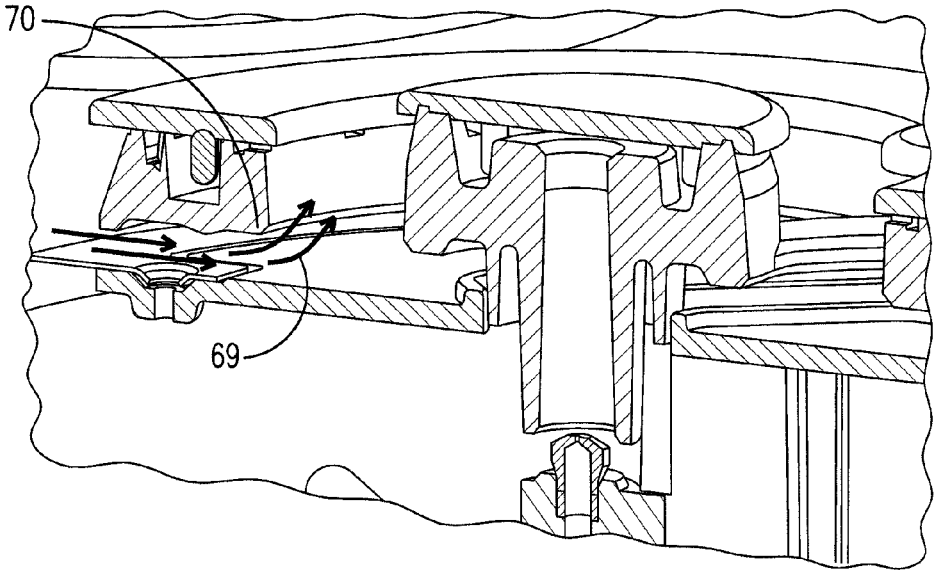
FIG. 21 shows a cross section of the flow of secondary air in the burner.
Figure 22:
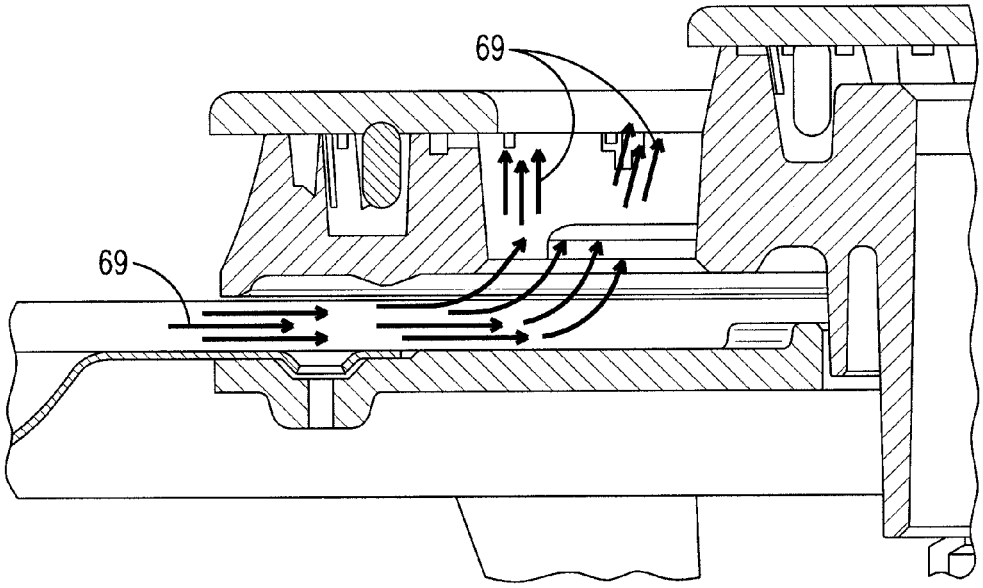
FIG. 22 shows another cross section of the flow of secondary air in the burner.
Figure 23:
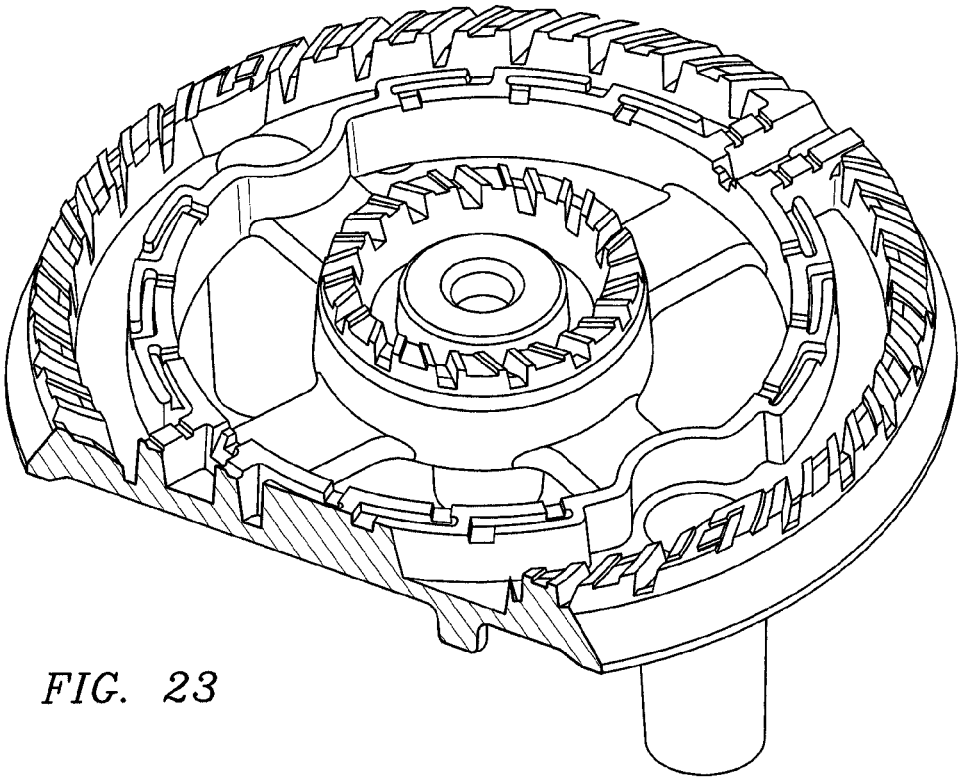
FIG. 23 shows an isometric view with a cut.
Figure 25:
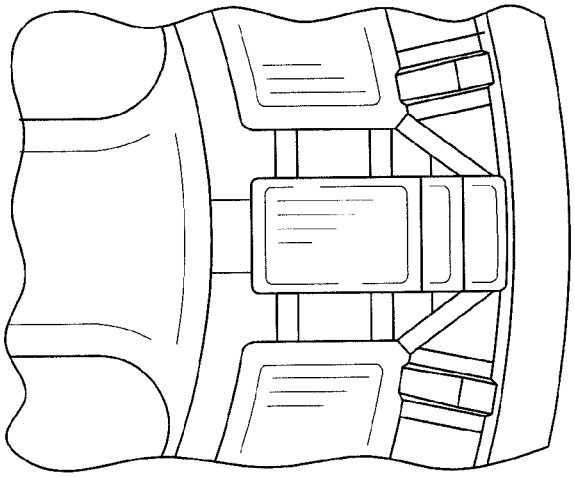
FIG. 25 shows an upper view of a detailed view of the first embodiment.
Figure 24:
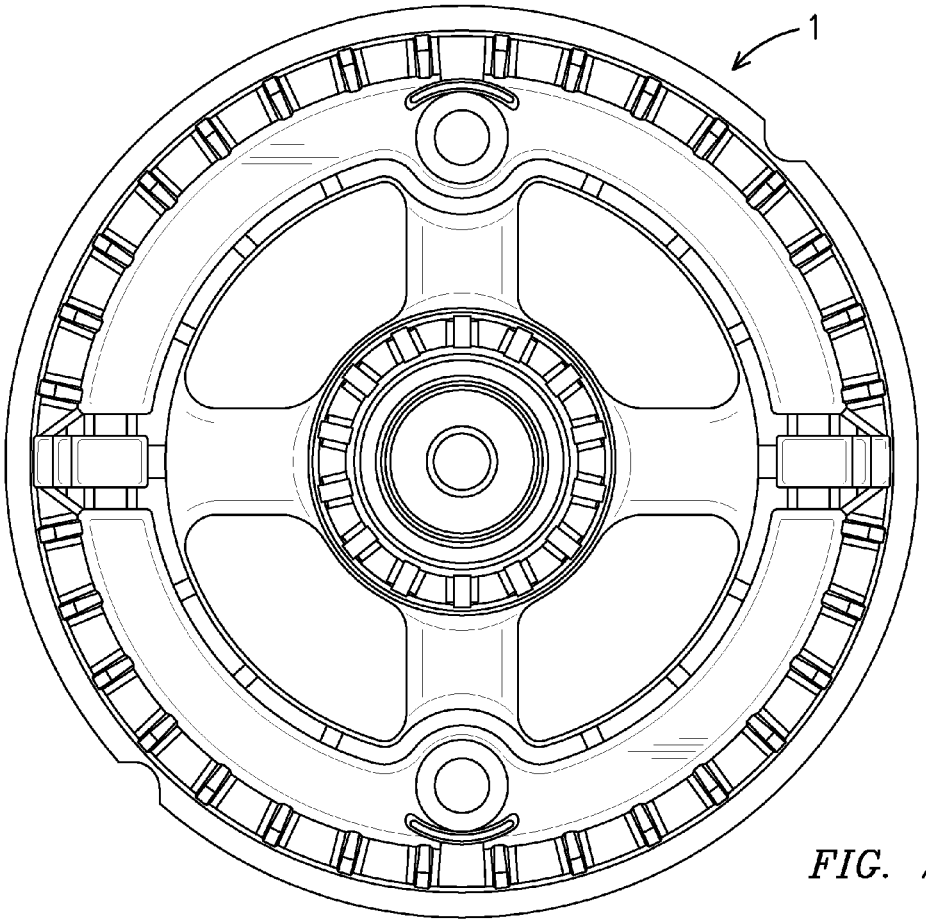
FIG. 24 shows an upper view of a first embodiment.

The following describes in detail form the burner with at least two sections of the present invention, using reference numbers which appear in each of the drawings 1-26 to identify the parts referred to in the description. The burner with at least two sections, preferably with three sections with either inclined or straight flames object of the present invention (1), comprises as principal elements the following: at least one lid per each section; an inner (2), and another outer (3); a burner head (4) which contains the two flame sections, an inner ring (5), a intermediate segment (6) and an outer segment (7), each segment containing combustion ports, in corresponding form identified with numbers (8), the combustion ports of the inner ring (5), combustion ports (9) of the intermediate segment (6) and combustion ports (10) of the outer segment (7), the gas exit combustion ports in their ensemble are helicoids, curved or straight, or any of the previous with an inclination, both in the inner segment (5) as in the outer (7) being such that if they are helicoid the flames will have an inclination. The flame inclination can have a clockwise or an anti-clockwise direction, where the direction on both burners can be the same or opposite directions; some mixture chambers (21) and (22) between each of the sections of the burner's main body, which are all separated by a space (23), in the wall's upper part of the mixture chambers (21) there are combustion ports of reduced size (24) whose function is to transmit the gas-air mixture between the sections; at least one Venturi duct in each section and the inner ring placed in the lower part of the burner's head (4), which form an integral part of the same, two lateral (11) and (12) and one central (13), through which the gas-air mixture enters the burner (1); four exits (27) thru (30) with a design similar to ingots, truncated cones, are found in the lower surface (26) of the head of the burner (4), these exits create a separation between the plane of the burner's cover (31) and the lower surface (26) of the burner's head; a support (32) which joins to the stove's surface for example via perforations and screws, in this support are lodged the Venturi ducts (11) to (13) of the burner head (4) in the lower part of the support (32) a gas distributor (14) is lodged which has three exits, two laterals (15) and (16) and one central (17) unto which the corresponding gas nozzles are connected, two lateral (18) and (19) and one central (20), the gas distributor (14) is designed in such a way that it can be connected to a valve, not shown, with double gas exits or a simple exit valve, in this way, the inner ring can function in conjunction with the other two sections, or in an embodiment of the present invention, independently of the other two sections, thus controlling the heating intensity; at least one arm (25), connected and granting mechanical rigidity to the burner head as well as guarantee the three rings concentricity as well as their separation, alternately a first set of arms runs on the axis of the Venturi conduits (11), (12) and (13); alternatively the remaining arms give the appearance coupled to the functions described above to the arm sets; a lighting spark plug (61) placed close to the outer segment and another lighting spark plug placed close to the inner ring (62) so that this may move the flame to the remaining sections.

The inner lids (2) and the outer (3) are made of imprinted and/or porcelain steel or any other known material known in the art such as steel smelting and/or sintering. The lids are placed over the combustion ports of the burner and its correct placement is controlled by the bolts (63) of the lids with a poka-yoke design which avoid incorrect placement, the inner lid (2) is placed over the inner ring (5) and the outer lid (3) is placed over the intermediate segments (6) and the outer segments (7).

In the burner (1) there are inclined combustion ports (33) and main combustion ports (34) which can be curved or straight on the outer segment (7); straight or radial combustion ports (35) in the intermediate segment (6), the difference between these last two being the velocity which can be acquired by the air mixture—gas which passes between the combustion ports, in the first, said mixture acquires higher velocity due to the curvature.

Main combustion ports (34), these can be straight or have an inclined angle in reference to the radius, or in a preferred embodiment follow a circumference arch (64), in other alternative embodiments, they can follow almost any type of curvature, i.e. exponential, elliptical, parabolic, hyperbolic etc. The characteristics of this type of combustion ports is that due to its inclinations or curvature the gas-air mix enters into it with a relatively low velocity and pressure, inside the combustion port with the curvature and the inclination of the combustion port, the mix accelerates and pressure is reduced, to the point where the mixture's exit velocity is slightly higher than the velocity of the burning gas to avoid gas return flashbacks, but avoiding reaching the limit where flame separation is produced; another advantage is that due to higher velocity of the particle inside the channel or combustion port passage, flames which are longer and more inclined are produced, which create a larger contact area between the flames and the objects to be heated, it is worth mentioning that the channel or combustion port passage has a particular cross section (36) which increasingly reduces the area of combustion port through which the volume of the gas-air mix passes, in drawing 13, it can be seen that two steps (38) in the deep part of the combustion port, these also help achieve an optimal velocity of the gas-air mix to be inside the operation zone between the flashback and the flame release; the steps (38) has a first slope between 10° and 30°, followed by a second slope between 0° and 15°, followed by a third slope between 30° to 80° and a fourth and last slope between 0° and 15°.

The moving combustion ports or carry over (33), also named inclined combustion ports posses the same inclination or curvature of the main or curved combustion ports (34); specifically these can be straight or have an inclination angle with reference to the radius, or in a preferred embodiment follow the circumference arch (64), in other alternative embodiments, they can follow almost any type of curve i.e. exponential, elliptical, parabolic, hyperbolic etc. The characteristics of this type of combustion ports is that due to their inclination or curvature, the gas-air mix enters into it with a relatively low velocity and pressure, inside the combustion port with the curvature, the mix accelerates and pressure is reduced to the point where the mixture's exit velocity is slightly higher than the velocity of the burning gas to avoid gas flashbacks, but avoid reaching the limit where flame separation is produced; another advantage is that due to higher velocity of the particle inside the channel or combustion port passage, flames which are longer and more inclined are produced, which creates a larger contact area between the flames and the objects to be heated, it is worth mentioning that the channel or combustion port passage has a particular cross section (36) which reduces the area of combustion port through which the volume of the gas-air mix passes, in drawing 13, it can be seen that two steps (38) in the deep part of the combustion port, these also help achieve an optimal velocity of the gas-air mix to be inside the operation zone between the flashback and the flame release; the steps (38) have a first slope between 10° and 30°, followed by a second slope between 0° and 15°. These ports are characterized by having lesser height in regards to the lid than the curved combustion ports (34).

Radial or straight combustion ports (35) are radial combustion ports to the burner's circumference; they have a particular cross section in that they also use steps (38) to control its velocity.

Figure 26:
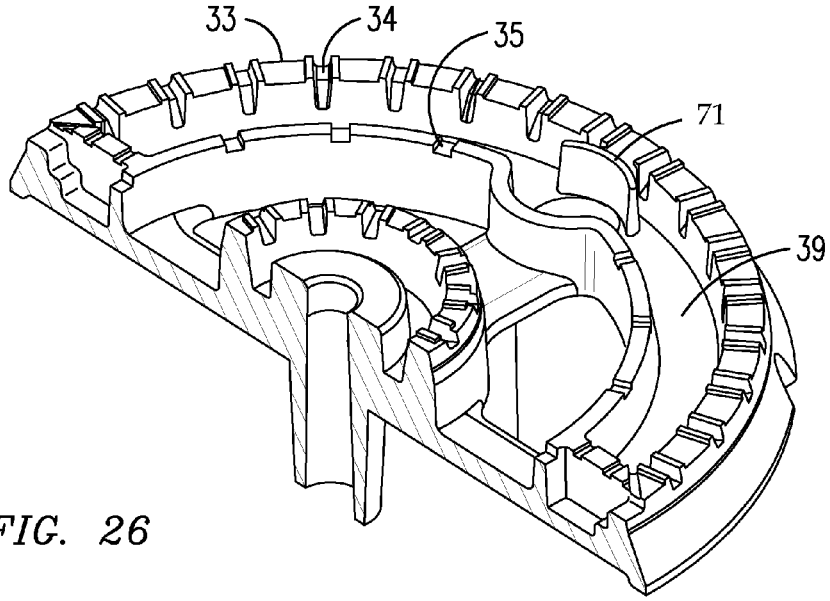
FIG. 26 shows an isometric view with a cut of the first embodiment.

Barrier rails (71), as shown in FIG. 26. These are walls or flow restrictions, they are named after the barrier rails in bullfighting rings; where said barrier rails help dissipate the gas air mixture and by doing so, the particles which enter the combustion ports have a lesser velocity, in the case of the burner with straight combustion ports, they are placed between combustion ports (33 and 34) of the outer segment (40) and in close proximity to the Venturi main channel exit (39).

Labyrinths (37). They are walls or flow restrictions which guide the flow towards the straight or radial combustion ports (35), said labyrinths help dissipate the gas air mixture and by doing so, the particles which enter the combustion ports have a lesser velocity. There are two zones with high mixture velocity; one is found on the combustion ports closest to the Venturi's download and the other in the zone of the combustion ports of the intermediate ring. If the mixture exits the combustion ports at this velocity, a separation of flame will occur, for this reason some walls with grooves are added with the purpose of creating velocity losses to the mixture due to friction.

Zone of combustion ports dissipation (64). Zones where the combustion ports are in close proximity to the Venturi, zone with walls or flow restrictions resembling an alley which help dissipate the energy of the gas-air mixture and thus the particles which enter this zone have a lesser velocity due to their proximity to the Venturi. Should this zone of combustion port dissipation (64) not be used, the gas-air mixture exits the combustion ports at a high velocity and flame separation occurs, thus walls resembling a meandering alley are added in combination with shallow combustion ports with the objective of producing energy loss to the gas-air mixture.

Flame moving chambers are placed between each section; in this case, the first is (44) and the second (45). They have a gas volume with a tenuous flame, and acting as a stability chamber as well, in addition to their function of moving the flame. The flame moving chambers (44) and (45) also have a radial stair stepped combustion port, respectively (46) and (47), and these have the peculiar function that when the burner is found at a minimal regimen or to have a minimal flame, said chamber conserves or maintains a small flame which exits the deepest part of the stair step's cross section (38); this flame helps re-light (in its case) the intermediate ring, granting the burner flame stability; the four mini-combustion ports (24) are the connection between the burner's sections (40) to (43) and are also the connection between the outer segment (7) and the intermediate (6).

Venturis. The lateral Venturi ducts (11) and (12) are placed decentralized from the main channel (39)between the combustion ports of the outer segment (7) and the combustion ports of the intermediate segment (6); this is so that if said Venturis were to be centrally placed in the intermediate circumference of said main channel, the gas-air mixture, would exit at such a high velocity and pressure, which would be undesirable for the combustion ports surrounding the Venturi since that would create the phenomenon of flame detachment, so it was determined to move it towards the center of the burner, this un-alignment creates space to mount barrier rails or labyrinths or to remove the Venturi from the combustion ports so that the gas-air mixture might experience a loss of velocity and dissipation some energy.

The Venturi ducts (11), thru (13) are placed on an axis, the burner in the present invention requires at least two Venturis for its own function, the sections are divided into two segments (40) and (41), for the outer segment (7); and (42), (43) for the intermediate segment (6); so that the main channel (39) between the outer segment (7) and the intermediate segment (6) is truncated by the gas moving chambers (44) and (45), which are placed 180° from each other in relation to the burner's center, the Venturi (11) feeds a section of the segments (40), (42) and the Venturi (12) opposite to 180° in relation to the burner's center feeds the segment section (41), (43), while the central Venturi (13) feeds the outer ring (5). Each of the Venturi ducts (11) thru (13) are aligned with gas nozzles, two lateral (18) and (19) and one central (20), which are placed on the lower part of the corresponding Venturi ducts, the nozzle (18) under the Venturi duct (11), the nozzle (19) under the Venturi duct (12), and the nozzle (20), under the central Venturi duct (13).

In a preferred embodiment, a valve controls the three rings in unison, via the gas distributor (14), in a different embodiment, there is a double valve or two valves, one which controls the feeding of the sections and another which controls the feeding of the inner ring (5), in this last one, the spark plug will be placed in near proximity to the inner ring (5) so that this may move the flame to the remaining sections, in this embodiment, the inner ring will be lit first and this must remain lit while the other two sections are in use, in this same embodiment, the inner ring may be solely lit, without lighting the other two sections, but it is not possible to operate in the reverse.

Inner ring (5). The combustion ports (8) of the inner ring (5) may or may not have the same curvature or inclination of those present in the other two sections; this ring may have radial or straight combustion ports or combustion ports whose inclination is opposite to that of the combustion ports of the outer segment, thus its function is somewhat independent of the other two sections. It is independent if the valve has a double exit and one of the exits supplies the flow solely to the intermediate burner, however heat flow and combustion products of the intermediate and outer rings have an effect on the inner ring's (5) performance.

Locating ring (65). It is found surrounding the central Venturi and aids in centering the burner unto its base (66), the remaining Venturi has a rib (67) along the length of its axis which fits itself unto the support (32) to avoid rotation.

The support (32) of the burner (1), has a circular design in its upper part, on its periphery it possesses four perforations (48) thru (51) which aid in joining the support to the stove's surface rendering it immovable via any means of mechanic fastening, for example fasteners or screws and nuts; the support (32) has three spaces, which are projected towards the lower part of the support (32), two laterals (52) and (53) and one central (54) which communicate among each other and are placed on a diametric axis of the support (32), the lateral spaces are hinged by vertical walls (55) and (56), their lower part (57) being open, whereas the central space (54) does not have any walls; when the burner's head (4) is assembled unto the support (32), the lateral spaces (52) and (53) lodge the lateral Venturi ducts (11) and (12), and the central space (55) the central Venturi duct (13). The spaces described above help cover the nozzles (18) through (20) which feed the Venturi, they also have a separation (68) between the burners' covers plane and the lower part of said support (32), this separation allows proper aeration of the segments (6) and (7) as well as provides the air for the mixture of primary air in the nozzle zone and the lower part of the central Venturi duct (13). The lower part of the support (32), lodges a gas distributor (14), to which we have previously referred, the corresponding gas nozzles; two lateral (18) and (19) and one central (20) are placed on the lower part of the corresponding Venturi ducts, the spreading bolt (19) under the Venturi duct (12) and the spreading bolt (20) under the central Venturi duct (13), between each of the nozzles and the Venturi ducts, there are spaces, two lateral (58) and (59) and one central (60).

The four exits (27) through (30) have a design similar to ingots, truncated cones, found on the lower surface (26) of the burner head (4), previously mentioned, create a separation, where said separation allows the flow of secondary air (69) towards the combustion ports or flames of the intermediate segment and the inner ring, towards the edge which forms the burner's base with the intermediate segment's wall, just beneath the combustion ports which have a bevel or radio (70), which allow better air flow between the burner's base lower face and the burners' covers plane, transporting more secondary air towards the combustion ports of the intermediate segment (6) and the inner ring (5).

The above mentioned exits (27) through (30) also help avoid the cover's yellowing due to the transfer of heat between the base and the burner head (4), since by making an air mass flow between the separation created by these two parts, the air which passes through here cools the burner's head base (4) functioning as a heat exchanger and acts as an insulator to heat transmission by radiation to the cover.

Primary air. This is the air which is introduced into the burner and mixes with the gas before this reaches the combustion ports.

Secondary air. This is the air supplied externally to the flame at the moment in which combustion occurs. Given that there are no openings in the support (32), the primary air is not contaminated with hot air and combustion products emanating from the oven, allowing for a more efficient combustion and avoiding disturbances to the burner's flames. In a preferred embodiment the support (32) can be totally sealed, or without openings, except for the upper part, the Venturis are found immersed within this support (32), where there is a volume of air, this volume of air is maintained due to the separation which exists between the burner head (4) and the support (32), said air volume is fed to the Venturi; the lateral Venturi ducts (11) and (12) have some spaces (58) and (59) in their lower part which allow for air flow. The central Venturi has some lateral spaces (60); in a preferred embodiment the spaces are in the lower part which feed the Venturis on their extremes, they can be covered and air pulled from above the burner's covers (through the space between the burner's base and the burner's lid; in an alternative embodiment, a "spider" type can be present, this being where there is a single support for the nozzles and the tubes are aligned with the Venturi.

Whereas the above description contains many specific facts, these specific facts are not to be considered as limitations in attaining the invention's reach, but simply as exemplifications of the described embodiments. Those with technical ability in the subject of suspensions will visualize many other variations and different possible reaches, which are within this invention's reach.

The invention claimed is:

1. A burner having at least two concentric flame sections, the burner comprising:

a burner head, which contains the at least two concentric flame sections, wherein each section comprises an intermediate segment, an outer segment and a main channel located between the outer segment and the intermediate segment, wherein each segment comprises respective combustion ports, the respective combustion ports of the outer segment comprising a helicoid structure, which defines an inclination to produce inclined flames, the combustion ports of the intermediate segment comprising a straight structure, wherein each combustion port of the intermediate segment comprises a labyrinth;

a flame moving chamber disposed between each flame section, wherein the flame sections are covered by a lid;

at least one Venturi duct in each flame section with an exit to the main channel; and at least one exit disposed on a lower surface of the burner head to aerate the burner head, wherein the combustion ports comprise a main combustion port having a cross-sectional area defined by a plurality of steps, the plurality of steps defining a slope sequence arranged to control a velocity of a combustion mixture flowing there through, the slope sequence defined by the plurality of steps comprising a first slope in a range from 10° to 30°, a second slope in a range from 0° to 15°, a third slope in a range from 30° to 80° and a fourth slope in a range from 0° to 15°, wherein the combustion ports of the central burner head define an inclination, wherein the inclination of the burner head and the inclination of the central burner are arranged in a clockwise direction or in a counter-clockwise direction, and the inclination directions in both burners is the same or opposite with respect to one another.

2. The burner according to claim 1, wherein the burner further comprises:

a support joined to a surface of a heating element, wherein each Venturi duct is disposed in the support;

a gas distributor disposed in a lower part of the support, the gas distributor including a gas exit for each Venturi duct; and a gas nozzle exit in each Venturi duct.

3. The burner according to claim 1, wherein the burner includes a central burner head joined to a remaining portion of the burner head by at least one arm, wherein the central burner head comprises a lid, a Venturi duct and a plurality of combustion ports.

4. The burner according to claim 1, wherein each labyrinth comprises respective walls or flow restrictors, wherein each labyrinth is located upstream from the combustion ports of the intermediate segment.

5. The burner according to claim 1, wherein the flame moving chambers have a radial stair-stepped combustion port, with at least two mini-combustion ports arranged to feed a combustion mixture.

6. The burner according to claim 2, wherein the support is circular and joined in a fixed manner to a burner cover, wherein the support comprises at least two spaces which project towards the lower part of the support, wherein the support further comprises two lateral spaces and one central space arranged to communicate between the lateral spaces and placed in a diametric axis of the support, the lateral spaces are hinged by vertical walls, wherein a respective lower part of each lateral space is open, wherein the central space has no walls, wherein in an assembled condition one or more lateral Venturi ducts are disposed in the lateral spaces.

7. The burner according to claim 2, wherein the support is sealed or without apertures, except for an upper part thereof, wherein an air volume is trapped, and said air volume is maintained due to a separation between the burner head and the support, wherein spaces in a lower part of the support feed a respective distal end of said at least one Venturi duct, wherein the spaces in the support are covered so that air enters through a top of a burner cover or wherein the support comprises a spider structure arranged as a support for the nozzles and a tube aligned with said at least one Venturi duct.

8. The burner according to claim 2, wherein the gas distributor comprises nozzles in at least two of its exits.

9. The burner according to claim 2, wherein the burner comprises a base and a wall in the intermediate segment configured to form an edge underneath the combustion ports, wherein the edge defines a bevel or a transition.

10. The burner according to claim 1, wherein the burner has an area of combustion ports for dissipation of flow velocity.

11. A burner having at least two concentric flame sections, the burner comprising:

a burner head, which contains the at least two concentric flame sections, wherein each section comprises an intermediate segment, an outer segment and a main channel located between the outer segment and the intermediate segment, wherein each segment comprises respective combustion ports, wherein the combustion ports of the outer segment and the combustion ports of the intermediate segment are straight;

a flame moving chamber between each section;

at least one Venturi duct in each flame section with an exit to the main channel;

at least one exit disposed on a lower surface of the burner head to aerate the burner head; and a barrier rail disposed between the combustion ports of the outer segment and proximate to the exit of said at least one Venturi duct, wherein the combustion ports comprise a main combustion port having a cross-sectional area defined by a plurality of steps, the plurality of steps defining a slope sequence arranged to control a velocity of a combustion mixture passing there through, the slope sequence defined by the plurality of steps comprising a first slope in a range from 10° to 30°, a second slope in a range from 0° to 15°, a third slope in a range from 30° to 80° and a fourth slope in a range from 0° to 15, wherein the combustion ports of the central burner allow a clockwise, anti-clockwise or bidirectional flame inclination.

12. The burner according to claim 11, wherein the burner further comprises:

a support joined to a surface of a heating element, the support arranged to accommodate said at least one Venturi duct;

a gas distributor disposed in a lower part of the support, the gas distributor including a gas exit for each Venturi duct; and a gas nozzle exit in each Venturi duct.

13. The burner according to claim 11, wherein the burner includes a central burner head joined to a remaining portion of the burner head by at least one arm, wherein the central burner head has a lid, a Venturi duct and a plurality of combustion ports.

14. The burner according to claim 11, wherein the flame moving chambers have a radial stair-stepped combustion port, with at least two mini-combustion ports arranged to feed a combustion mixture.

15. The burner according to claim 12, wherein the support is circular and joined in a fixed manner to a burner cover, wherein the support comprises at least two spaces which project towards the lower part of the support, wherein the support further comprises two lateral spaces and one central space arranged to communicate between the two lateral spaces and placed in a diametric axis of the support, the lateral spaces are hinged by vertical walls, wherein a respective lower part is open, wherein the central space has no walls, wherein in an assembled condition one or more lateral Venturi ducts are disposed in the lateral spaces.

16. The burner according to claim 12, wherein the support is f-sealed or without apertures, except for an upper part thereof, wherein an air volume is trapped and said air volume is maintained due to a separation between the burner head and the support, wherein spaces in a lower part of the support feed a distal end of said at least one Venturi duct, wherein the spaces in the support are covered so that air enters through a top of a burner cover or wherein the support comprises a spider structure arranged as a support for the nozzles and a tubes aligned with said at least one Venturi duct.

17. The burner according to claim 12, wherein the gas distributor comprises nozzles in at least two of its exits.

18. The burner according to claim 12, wherein the burner comprises a base and a wall in the intermediate segment configured to form an edge underneath the combustion ports, wherein the edge defines a bevel or a transition.

19. An igniting method for a burner having at least two flame sections, wherein each section comprise an outer segment and an intermediate segment, the outer segments configured to produce one of inclined flames and straight flames, with a spark plug in close proximity to an inner ring, the method comprising:

lighting the inner ring with the spark plug;

moving the flame of the inner ring to the intermediate segments;

moving the flame of the intermediate segments to the outer segments;

arranging in a main combustion port a plurality of steps which define a cross sectional area in said main combustion port; and controlling a velocity of a combustion mixture passing through the main combustion port based on a slope sequence defined by the plurality of steps, wherein the slope sequence defined by the plurality of steps comprises a first slope in a range from 10° to 30°, a second slope in a range from 0° to 15°, a third slope in a range from 30° to 80° and a fourth slope in a range from 0° to 15, wherein the combustion ports allow a clockwise, anti-clockwise or bidirectional flame inclination.

20. The method according to claim 19, wherein the moving of the flame between the intermediate segments and the outer segments occurs by way of a moving chamber between each one of the sections.

* * * * *